US011805840B2

(12) United States Patent
Wright et al.

(10) Patent No.: US 11,805,840 B2
(45) Date of Patent: Nov. 7, 2023

(54) HAT AND CAP MODIFICATION SYSTEM AND METHOD OF USE

(71) Applicants: Ryan J. Wright, Olathe, KS (US); Rashawnda M. Wright, Olathe, KS (US); Myayla M. Wright, Olathe, KS (US)

(72) Inventors: Ryan J. Wright, Olathe, KS (US); Rashawnda M. Wright, Olathe, KS (US); Myayla M. Wright, Olathe, KS (US)

( * ) Notice: Subject to any disclaimer, the term of this patent is extended or adjusted under 35 U.S.C. 154(b) by 38 days.

(21) Appl. No.: 17/699,683

(22) Filed: Mar. 21, 2022

(65) Prior Publication Data

US 2022/0295936 A1 Sep. 22, 2022

Related U.S. Application Data

(60) Provisional application No. 63/164,115, filed on Mar. 22, 2021.

(51) Int. Cl.
*A42B 7/00* (2006.01)

(52) U.S. Cl.
CPC ..... *A42B 7/00* (2013.01)

(58) Field of Classification Search
CPC ..... A42B 7/00; A42B 1/00; A42B 1/02
See application file for complete search history.

(56) References Cited

U.S. PATENT DOCUMENTS

| | | | | |
|---|---|---|---|---|
| 2,289,370 A * | 7/1942 | Krag | A42B 1/02 | 2/171.01 |
| 3,018,487 A * | 1/1962 | O'Reilly | A42B 1/02 | 2/171.01 |
| 3,134,107 A * | 5/1964 | Kelly | A42B 1/02 | 2/200.3 |
| 2004/0010840 A1* | 1/2004 | Lin | A42B 1/02 | 2/175.1 |

OTHER PUBLICATIONS www.gradcapremix.com, p. 1, 2023 (Year: 2023).*

* cited by examiner

*Primary Examiner* — Katherine M Moran
(74) *Attorney, Agent, or Firm* — Law Office of Mark Brown, LLC; Christopher M DeBacker

(57) ABSTRACT

A hat and/or cap modification system for modifying existing headwear to be wearable by wearers having curly hair, voluminous hair or otherwise challenging hair for wearing hats and caps in their standard orientation. The system includes a ring, cap plate, a securing platform or band, and a semi-rigid head band for modifying caps, such as graduation caps, so that anyone can wear it regardless of hairstyle.

4 Claims, 6 Drawing Sheets

HAT AND CAP MODIFICATION SYSTEM AND METHOD OF USE

CROSS-REFERENCE TO RELATED APPLICATION

This application claims priority in U.S. Provisional Patent Application No. 63/164,115 Filed Mar. 22, 2021, which is incorporated herein by reference.

BACKGROUND OF THE INVENTION

1. Field of the Invention

The present invention relates generally to a hat system and method for use thereof, and more specifically to a hat modification system for modifying existing hats and caps to be worn with wearers who have large, curly, or other hair styles making wearing hats and caps difficult without modifications thereto.

2. Description of the Related Art

Hats and caps are important for celebratory events, such as high school and college graduations and sporting events, can be a way for a person to personalize their outward appearance and messages they may want to send, as well as acting as functional headwear for blocking sun. Wearers who have curly hair, voluminous hair or otherwise challenging hair for wearing hats and caps in their standard orientation have to resort to stuffing the hat on their heads, modifying the caps using pins, tape, or other inconvenient methods, or foregoing the hat or cap altogether, which can be uncomfortable and can even lead to feeling left out.

Heretofore there has not been available a system or method for modifying headwear with the advantages and features of the present invention.

BRIEF SUMMARY OF THE INVENTION

The present invention generally provides a hat and/or cap modification system for modifying existing headwear to be wearable by wearers having curly hair, voluminous hair or otherwise challenging hair for wearing hats and caps in their standard orientation. A primary embodiment includes a ring, cap plate, a securing platform or band, and a semi-rigid head band for modifying caps, such as graduation caps, so that anyone can wear it regardless of hairstyle.

A secondary embodiment could modify existing baseball caps with a cap insert and semi-rigid headband to quickly and easily modify a baseball cap to fit any person's head and hairstyle. Similar elastic bands or other attachment elements can connect the insert to the cap and the headband to the insert.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Cap and Hat Modification System 2

Figure 1:
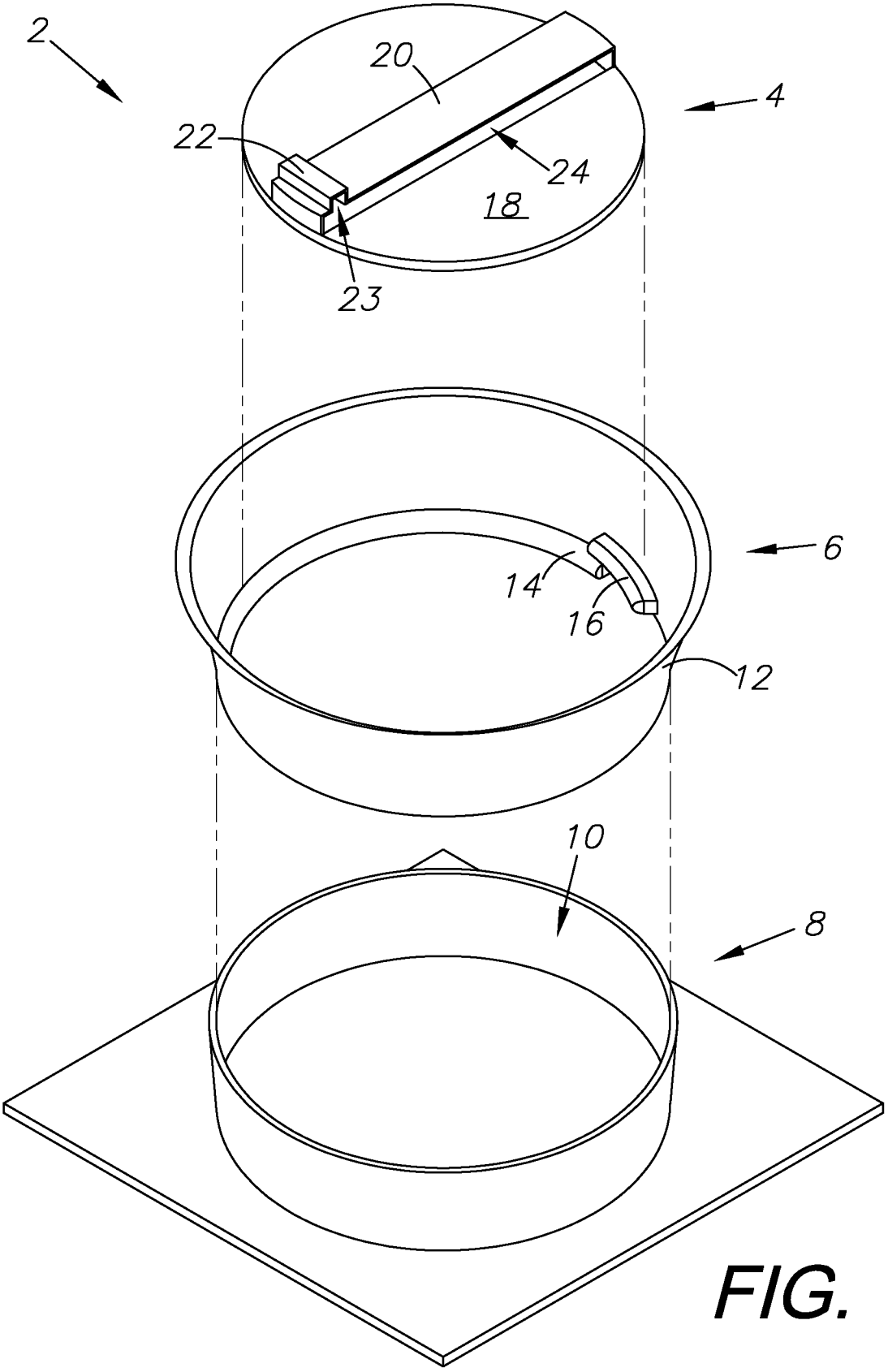
FIG. 1 is an exploded three-dimensional isometric view showing a preferred embodiment of the present invention as it would interface with a typical environment of a hat or cap.

As shown in FIGS. 1-5, the present invention features a hat or cap 8 modification system 2 which has a ring insert 6 for fitting around the outer edge of the hat or cap 8 and a top plate 4 which provides structural support between the ring insert and the upper portion of the hat. As shown in FIG. 1, the ring 6, which has a vertical body 12 which can be inserted into the interior 10 of the hat or cap 8. A lip 14 about the base of the ring 6 can receive the top plate 4. The base 18 of the flat plate sits atop the lip 14. A raised platform 20 with a secondary raised portion 22 forming a relief 23 can be slotted beneath tabs 16 on either side of the ring 6, such that the top plate 4 is secured between the tabs 16 and the lip 14 of the ring 6.

Figure 2:
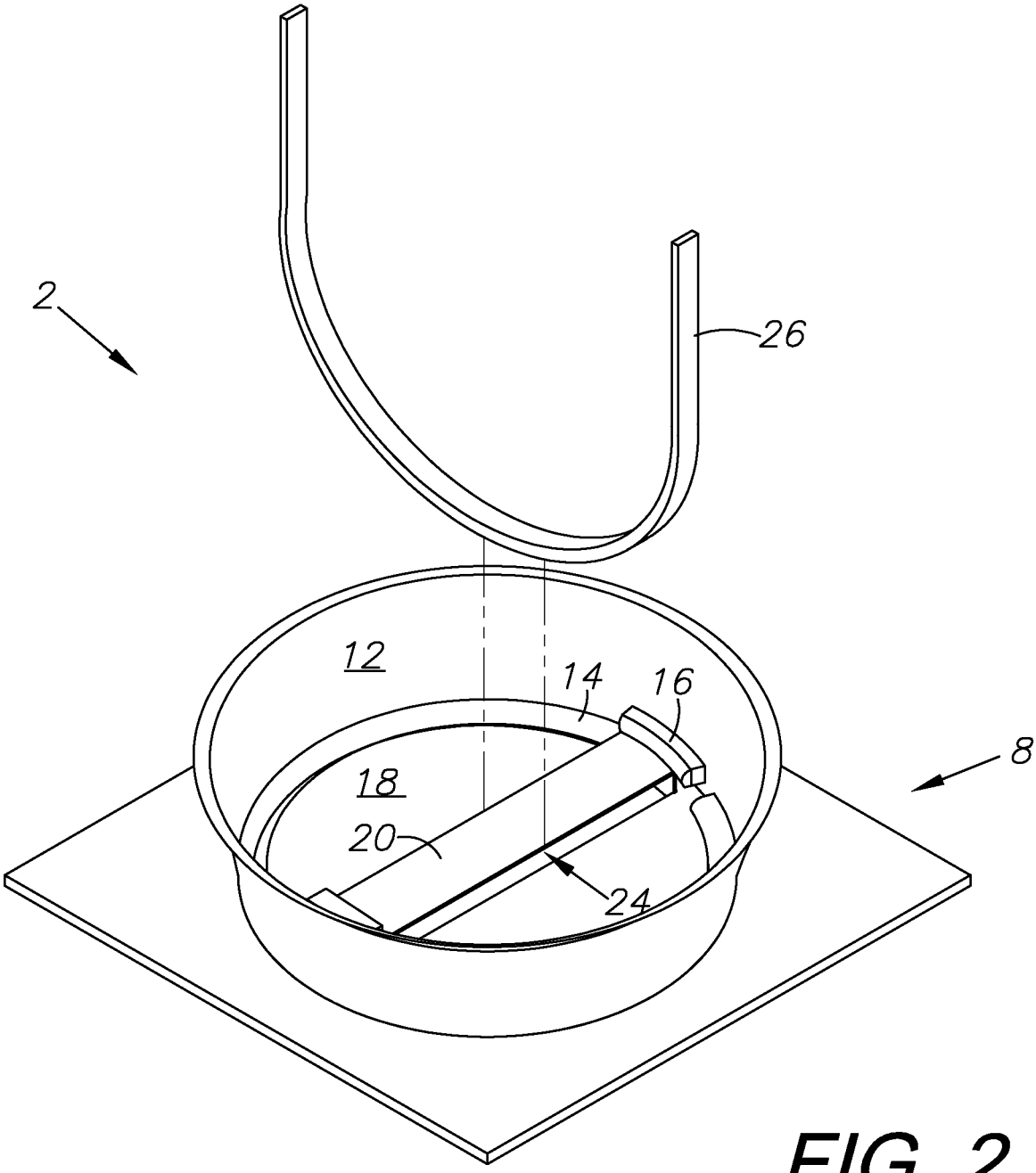
FIG. 2 is a three-dimensional isometric view thereof showing the invention placed within the hat or cap and with a semi-rigid head band element being inserted therein.
Figure 3:
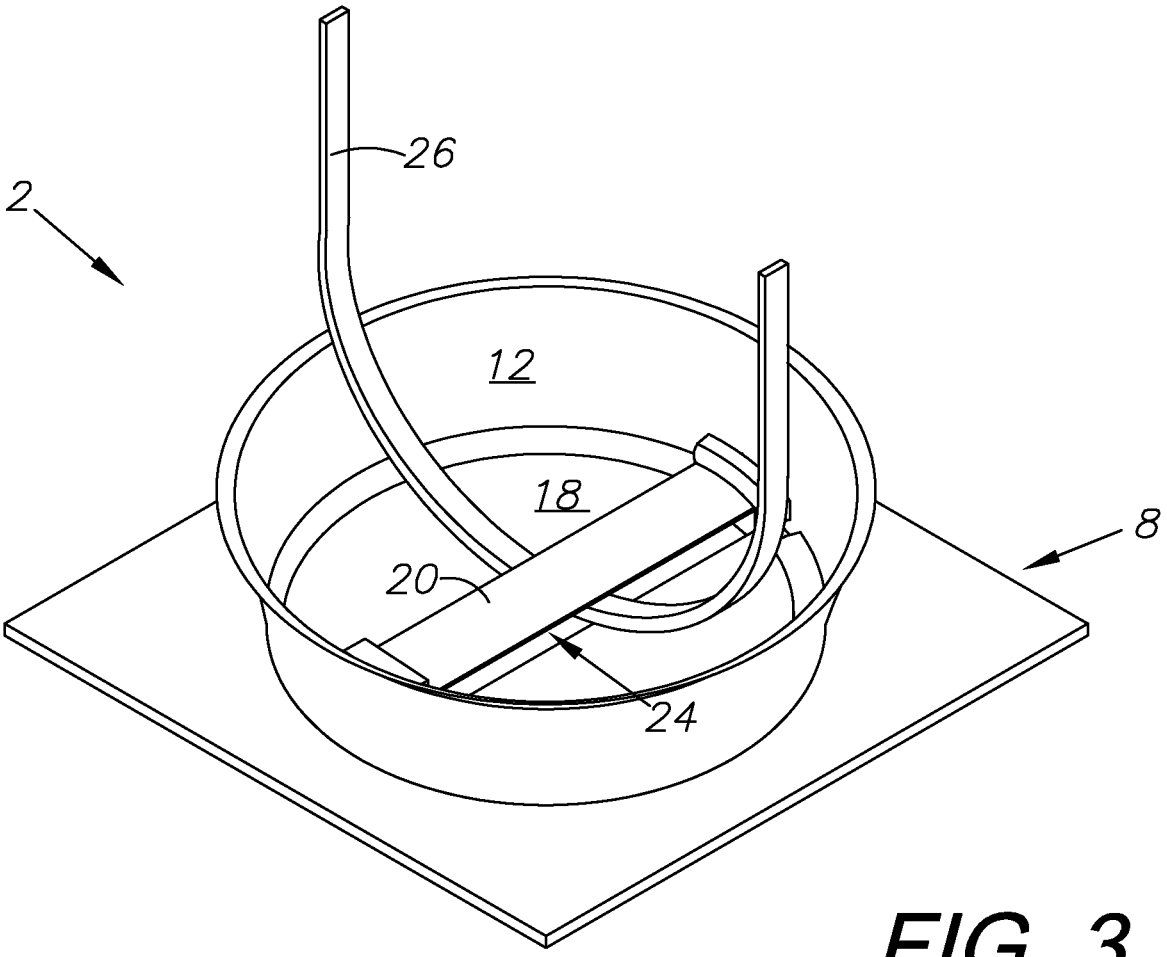
FIG. 3 is another three-dimensional isometric view thereof with the semi-rigid head band element fully inserted.

The raised platform 20, as shown in FIGS. 2 and 3, can receive a rigid headband 26 within a gap 24 formed between the raised platform 20 and the base 18. This allows the hat or cap 8 to be worn by securing the headband 26 into the hair of the wearer, and the headband secures the cap 8 via the top plate 4 and the ring 6. Other connection elements can also be used, such as one or more elastic bands, pins, hook-and-loop fasteners, or other suitable elements. In one example of a graduation cap, the sides of the cap can be tucked down over the ring insert and the headband secures the cap or hat to the wearer's head via their hair or simply by gripping the sides of the wearer's head, allowing for any person to wear the hat or cap regardless of hair style, volume, or other characteristics.

Figure 4:
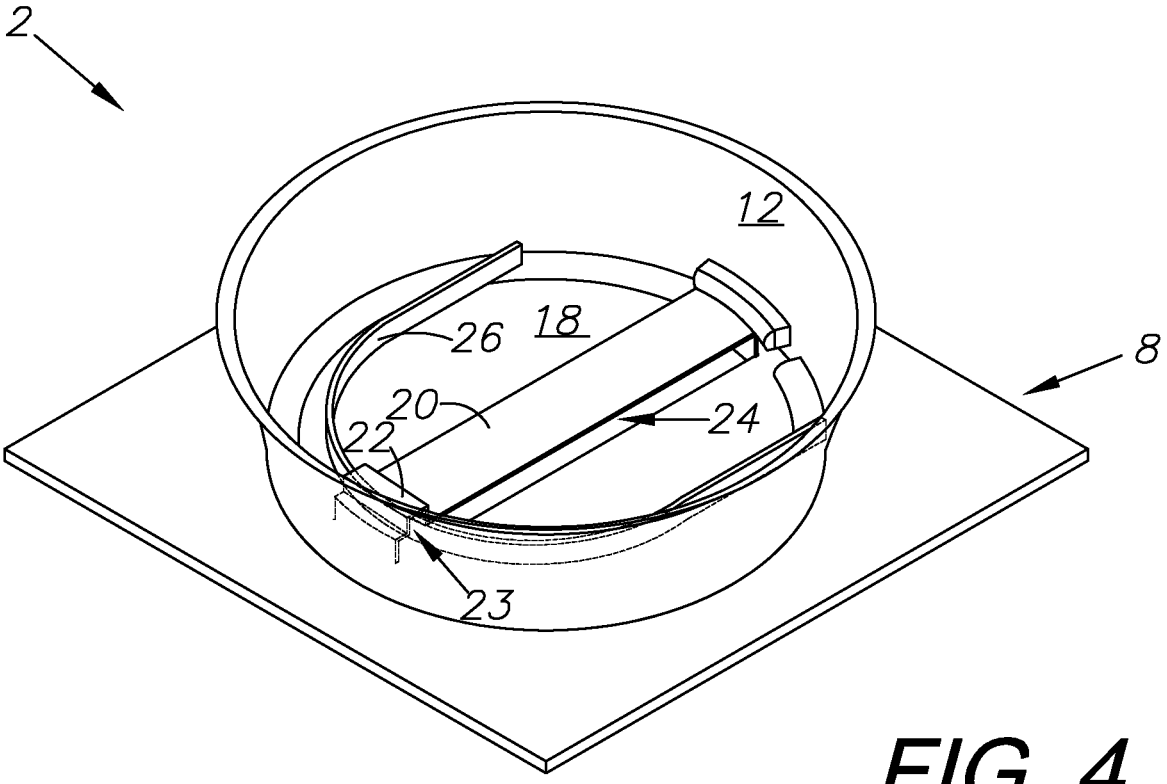
FIG. 4 is another three-dimensional isometric view thereof, showing the semi-rigid head band in a stored orientation.
Figure 5:
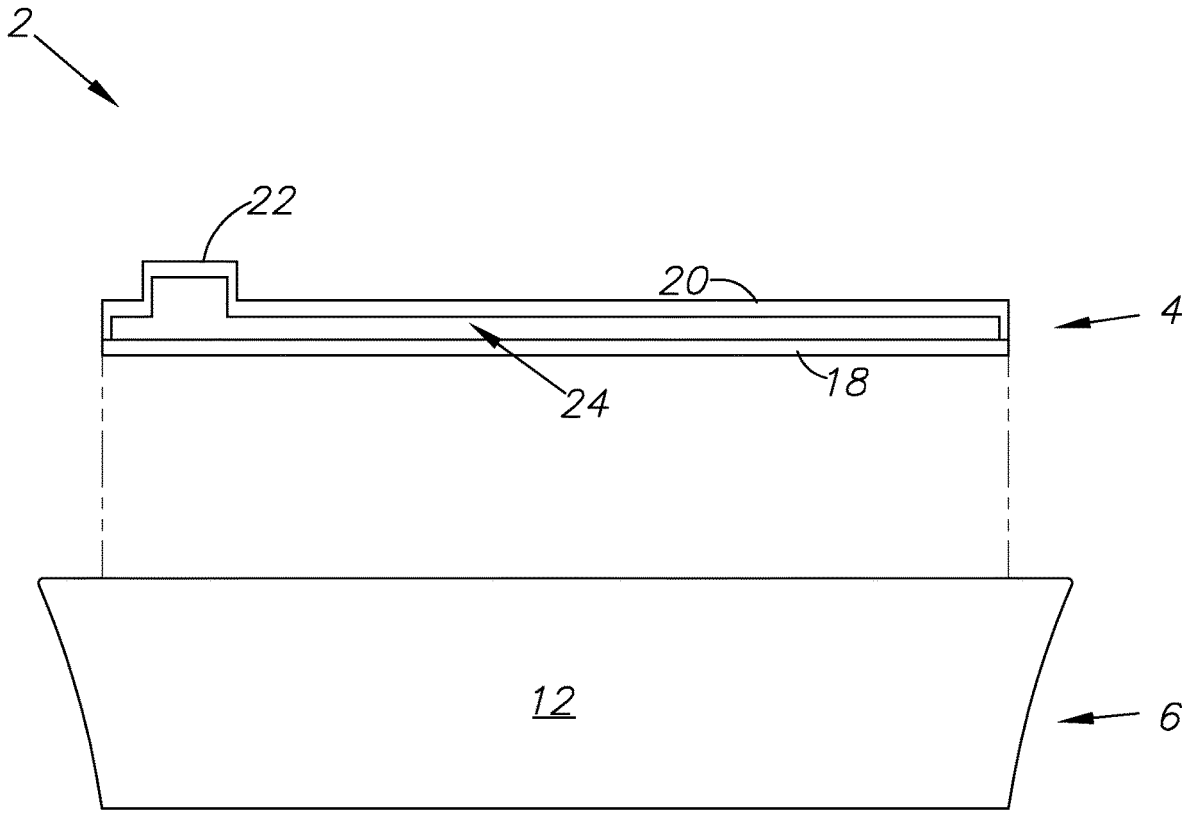
FIG. 5 is a side elevational view of a preferred embodiment of the present invention shown in a partially exploded view.
Figure 6:
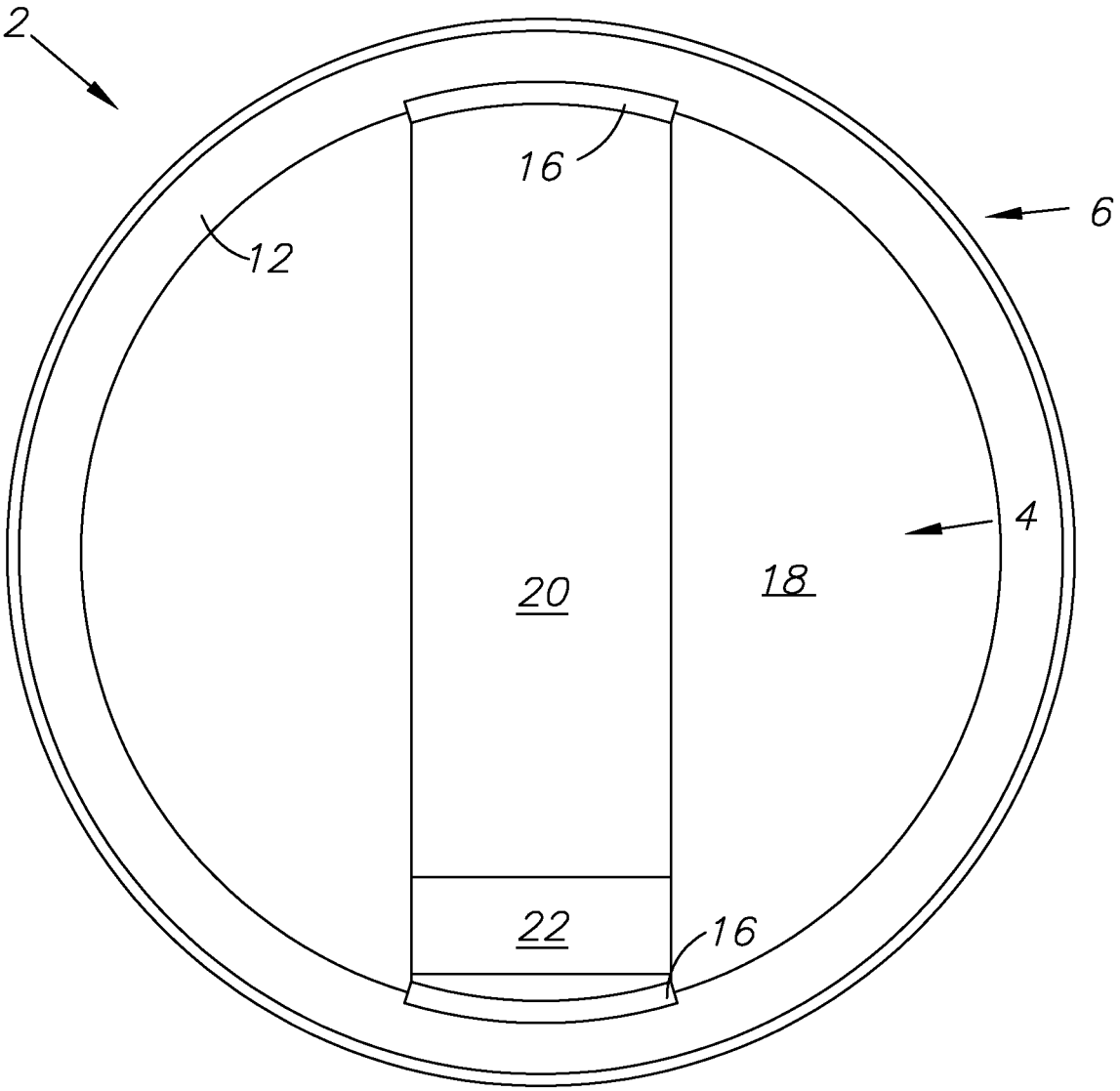
FIG. 6 is a top plan view thereof.

FIG. 4 shows how the semi-rigid head band 26 can be rotated down into the interior 10 of the hat 8, such as for storage or, in the case of a graduation cap, to toss the cap into the air. The semi-rigid head band 26 can be slotted into the relief 23 of the secondary raised section 22 for this purpose.

The present invention could fit most or all types of hats and caps. However, a modified version could be employed with a baseball cap, wherein the back portion of the baseball cap is collapsed towards the brim, and the device can be inserted at the back of the baseball cap with a semi-rigid headband or other securing device allowing the baseball cap to be secured to the user's hair.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A headwear modification system comprising:

a ring comprising a lip and at least one securing tab, said ring configured to be placed within an interior of a headwear item;

a plate comprising a base, a raised platform, and a space formed between said base and said raised platform;

said plate configured to be secured within said ring between said lip and said at least one securing tab;

a semi-rigid headband configured to be inserted through said space and be displaced between said base and said raised platform; and said semi-rigid headband configured to secure said headwear item to a wearer's hair.

2. The system of claim 1, further comprising:

said raised platform including a secondary raised platform located above said raised platform, said secondary raised platform forming a relief beneath it; and said semi-rigid headband configured to be transformed from a first, upright orientation for interfacing with hair, to a second, stored orientation parallel with a top surface of said headwear item and stored within said headwear item such that a portion of said semi-rigid headband is received within said relief.

3. A method of wearing a headwear item, the method comprising the steps:

providing a headwear item having an interior space;

placing a ring within said interior space, said ring comprising a lip and at least one securing tab;

placing a plate within said ring, said plate comprising a base, a raised platform, and a space formed between said base and said raised platform;

securing said plate between said lip and said at least one securing tab, such that said base engages said lip and said raised platform engages said at least one securing tab;

placing a semi-rigid headband through said space such that said semi-rigid headband is displaced between said base and said raised platform; and securing said headwear item to a user's hair via said semi-rigid headband.

4. The method of claim 3, further comprising the steps:

providing a secondary raised platform located above said raised platform, said secondary raised platform forming a relief beneath it;

rotating said semi-rigid headband downwards such that it is parallel with a top surface of said headwear item; and securing at least a portion of said semi-rigid headband within said relief, thereby transforming said semi-rigid headband from a first, upright orientation to a second, stored orientation within said interior of said headwear item.

* * * * *